US011631522B2

(12) United States Patent
Hur et al.

(10) Patent No.: US 11,631,522 B2
(45) Date of Patent: Apr. 18, 2023

(54) COIL COMPONENT AND METHOD OF MANUFACTURING THE SAME

(71) Applicant: SAMSUNG ELECTRO-MECHANICS CO., LTD., Suwon-si (KR)

(72) Inventors: Young Min Hur, Suwon-si (KR); Dong Ho Han, Suwon-si (KR); Boum Seock Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 278 days.

(21) Appl. No.: 16/893,826

(22) Filed: Jun. 5, 2020

(65) Prior Publication Data

US 2021/0057142 A1 Feb. 25, 2021

(30) Foreign Application Priority Data

Aug. 20, 2019 (KR) ..... 10-2019-0101941
Sep. 26, 2019 (KR) ..... 10-2019-0118705

(51) Int. Cl.
*H01F 27/28* (2006.01)
*H01F 41/04* (2006.01)

(52) U.S. Cl.
CPC ..... *H01F 27/2804* (2013.01); *H01F 41/041* (2013.01); *H01F 2027/2809* (2013.01)

(58) Field of Classification Search
CPC .. H01F 27/292; H01F 17/0013; H01F 17/045; H01F 27/2804
See application file for complete search history.

(56) References Cited

U.S. PATENT DOCUMENTS

2016/0351319 A1* 12/2016 Jeong ..... H01F 17/0033
2016/0351320 A1* 12/2016 Jeong ..... H01F 27/292
2017/0032885 A1* 2/2017 Lee ..... H01F 41/046
2017/0133145 A1 5/2017 Hong et al.
(Continued)

FOREIGN PATENT DOCUMENTS

JP H09153406 A 6/1997
JP H09270329 A 10/1997
JP 2001-203109 A 7/2001
(Continued)

OTHER PUBLICATIONS

Japanese Office Action dated Jun. 15, 2021 , issued in corresponding Japanese Patent Application No. 2020-095253 w/ English Translation.
(Continued)

*Primary Examiner* — Dinh T Le
(74) *Attorney, Agent, or Firm* — Morgan, Lewis & Bockius LLP

(57) ABSTRACT

A coil component includes a support substrate, a coil portion including a first conductive layer being in contact with one surface of the support substrate, and a second conductive layer disposed on the first conductive layer to be spaced apart from the one surface of the support substrate, and a body including the support substrate and the coil portion embedded in the body. One side of the first conductive layer is closer to a center of the second conductive layer in a width direction of the coil portion than one side of the second conductive layer.

23 Claims, 5 Drawing Sheets

'A'

(56) References Cited

U.S. PATENT DOCUMENTS

| | | | |
|---|---|---|---|
| 2018/0166194 | A1 | 6/2018 | Choi |
| 2019/0088407 | A1 | 3/2019 | Jung et al. |

FOREIGN PATENT DOCUMENTS

| | | | |
|---|---|---|---|
| JP | 2006-310716 | A | 11/2006 |
| JP | 2017-092444 | A | 5/2017 |
| KR | 10-2017-0123300 | A | 11/2017 |
| KR | 10-2018-0068203 | A | 6/2018 |
| KR | 10-2019-0032852 | A | 3/2019 |

OTHER PUBLICATIONS

Korean Office Action dated Nov. 6, 2020 issued in Korean Patent Application No. 10-2019-0118705 (with English translation).

* cited by examiner

COIL COMPONENT AND METHOD OF MANUFACTURING THE SAME

CROSS-REFERENCE TO RELATED APPLICATION(S)

This application claims benefit under 35 USC 119(a) of Korean Patent Application No. 10-2019-0101941 filed on Aug. 20, 2019 and Korean Patent Application No. 10-2019-0118705 filed on Sep. 26, 2019 in the Korean Intellectual Property Office, the entire disclosure of which is incorporated herein by reference for all purposes.

TECHNICAL FIELD

The present disclosure relates to a coil component and a method of manufacturing the same.

BACKGROUND

Inductors, as coil components, are typical passive electronic components used in electronic devices as well as resistors and capacitors.

In the case of a thin-film coil component, one type of coil component, a coil pattern is formed on an insulating substrate by a thin film process such as a plating process, a body is formed by laminating one or more magnetic composite sheets on the insulating substrate on which the coil pattern is formed, and an external electrode is formed on the body.

In forming the coil pattern of the thin-film coil component, a seed portion is formed on an insulating substrate, and a plating layer is formed by electroplating. In detail, the coil pattern is formed by first forming a seed pattern in a form corresponding to the coil pattern on one surface of the insulating substrate, and then forming a plating resist and performing electroplating. Alternatively, the coil pattern may be formed by forming a seed layer on the entirety of one surface of the insulating substrate, forming a plating resist and performing electroplating, and then removing the plating resist and removing an area of the seed layer, other than the area in which an electroplating layer has been formed.

On the other hand, in the latter method of forming a coil pattern, a laser may be used in removing the plating resist and the seed layer, and in this case, a portion of the insulating substrate may also be removed by the laser, thereby negatively affecting component characteristics.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

An aspect of the present disclosure is to provide a coil component in which the rigidity of a support substrate may be maintained while improving an aspect ratio (A/R) of each turn of a coil pattern.

According to an aspect of the present disclosure, a coil component includes a support substrate, a coil portion including a first conductive layer being in contact with one surface of the support substrate, and a second conductive layer disposed on the first conductive layer to be spaced apart from the one surface of the support substrate, and a body including the support substrate and the coil portion embedded in the body. One side of the first conductive layer is closer to a center of the second conductive layer in a width direction of the coil portion than one side of the second conductive layer.

BRIEF DESCRIPTION OF THE DRAWINGS

The above and other aspects, features, and advantages of the present disclosure will be more clearly understood from the following detailed description, taken in conjunction with the accompanying drawings, in which.

DETAILED DESCRIPTION

Figure 1:
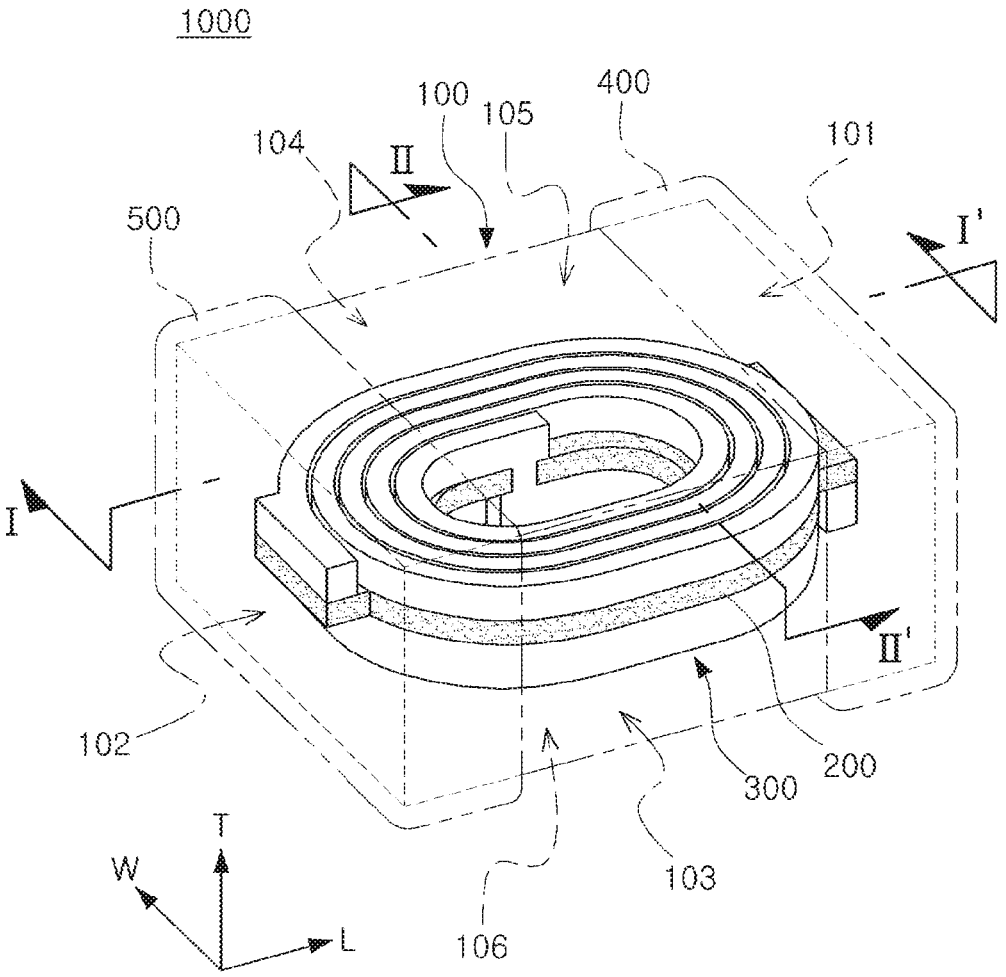
FIG. 1 is a view schematically illustrating a coil component according to an exemplary embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

A value used to describe a parameter such as a 1-D dimension of an element including, but not limited to, "length," "width," "thickness," diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The drawings may not be to scale, and the relative size, proportions, and depiction of elements in the drawings may be exaggerated for clarity, illustration, and convenience.

In addition, the combination means not only a case in which respective components are physically in direct contact with each other in a contact relationship between the respective components, but also a case in which other components are interposed between the respective components to be in direct contact with each other.

Since the size and thickness of each component illustrated in the drawings are arbitrarily illustrated for convenience of description, the present disclosure is not necessarily limited to what is illustrated.

In the drawings, an L direction may be defined as a first direction or a length direction, a W direction as a second direction or a width direction, and a T direction as a third direction or a thickness direction.

Hereinafter, a coil component according to an exemplary embodiment will be described in detail with reference to the accompanying drawings, and in describing with reference to the accompanying drawings, the same or corresponding components are assigned the same reference numbers and overlapped descriptions thereof will be omitted.

Various types of electronic components are used in electronic devices, and various types of coil components may be appropriately used to remove noise between the electronic components.

For example, in electronic devices, coil components may be used as power inductors, high-frequency inductors, general beads, high-frequency beads, and common mode filters.

Figure 2:
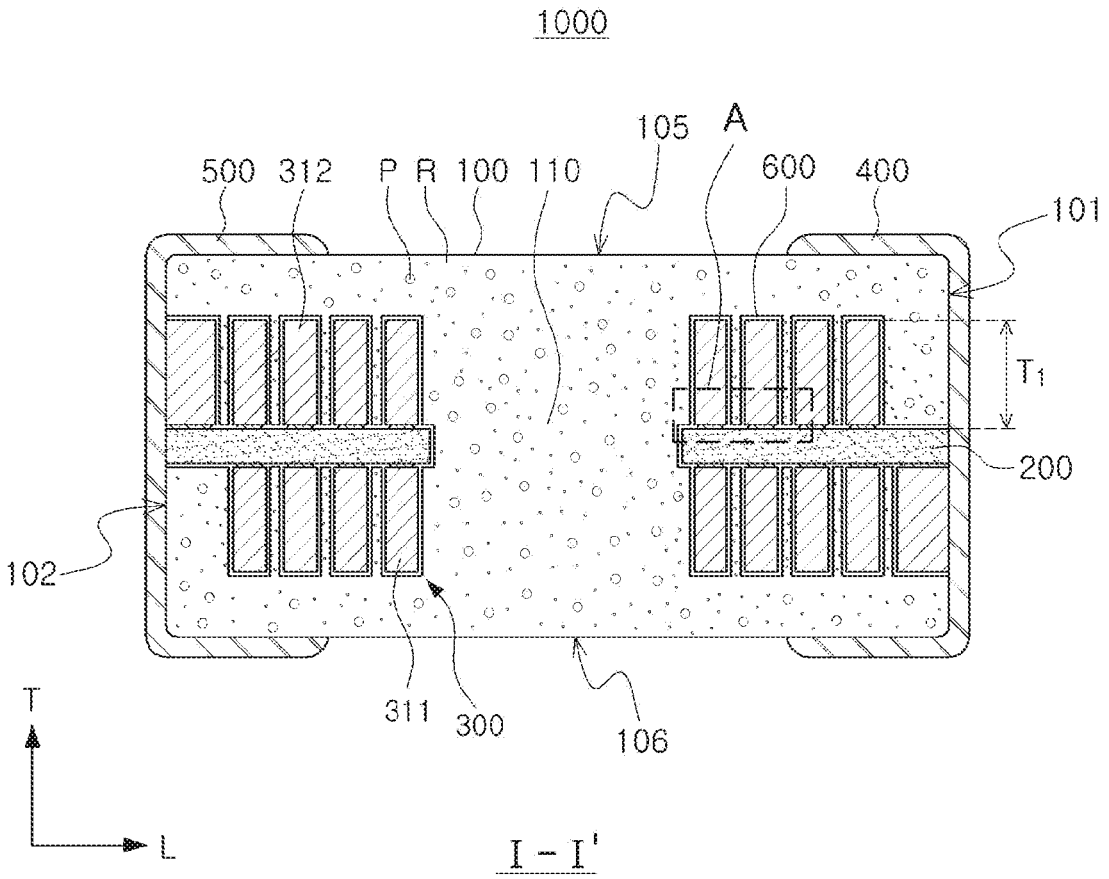
FIG. 2 is a view illustrating a cross section taken along line I-I' in FIG. 1.
Figure 3:
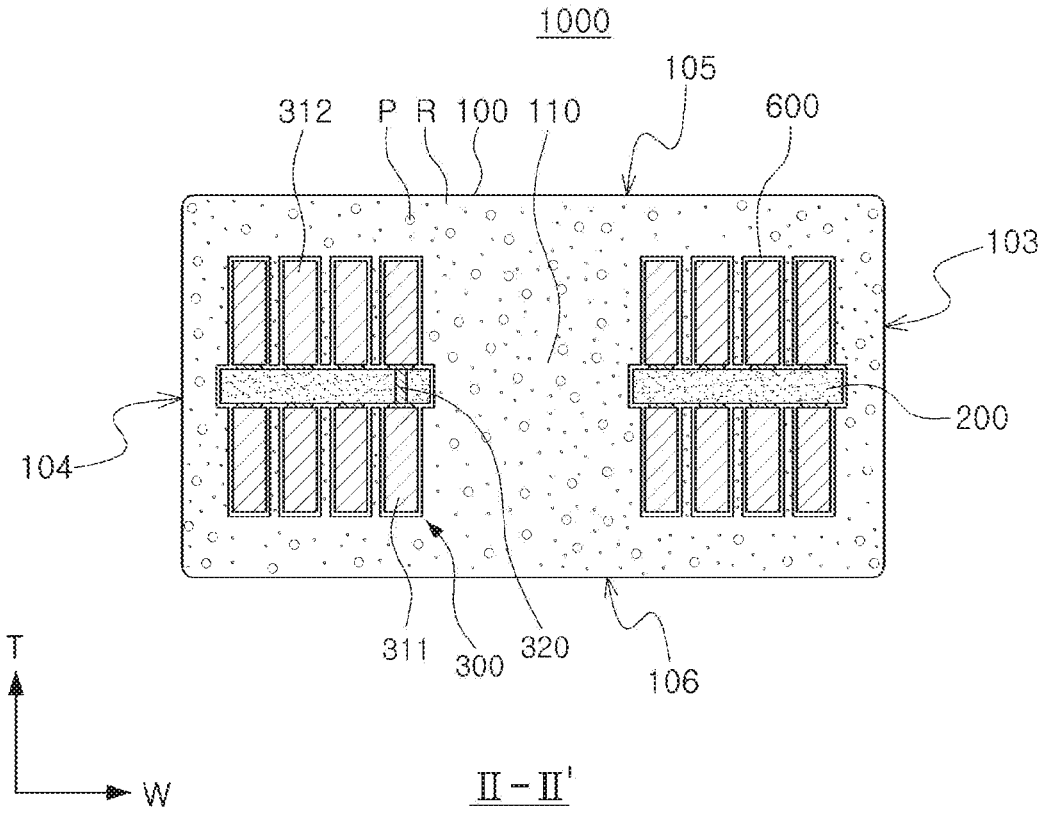
FIG. 3 is a view illustrating a cross section taken along line II-II' of FIG. 1.
Figure 4:
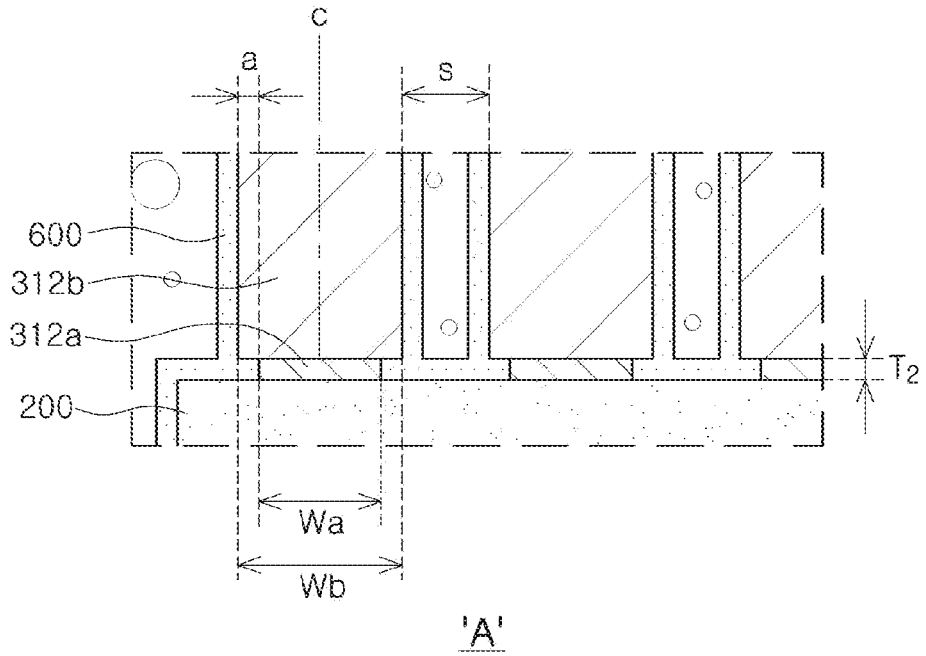
FIG. 4 is an enlarged view of region A in FIG. 2.

FIG. 1 is a view schematically illustrating a coil component according to an exemplary embodiment. FIG. 2 is a view illustrating a cross section taken along line I-I' of FIG. 1. FIG. 3 is a view illustrating a cross section taken along line II-II' of FIG. 1. FIG. 4 is an enlarged view of region A of FIG. 2.

Referring to FIGS. 1 to 4, a coil component 1000 according to an exemplary embodiment includes a body 100, a support substrate 200, a coil portion 300 and external electrodes 400 and 500, and may further include an insulating film 600.

The body 100 forms the overall exterior of the coil component 1000 according to this embodiment, and includes the support substrate 200 and the coil portion 300 embedded therein.

The body 100 may be formed to have the shape of a cube as a whole.

Referring to FIGS. 1 to 3, the body 100 includes a first surface 101 and a second surface 102 opposing each other in the longitudinal direction L, a third surface 103 and a fourth surface 104 opposing each other in the width direction W, and a fifth surface 105 and a sixth surface 106 opposing each other in the thickness direction T. The first to fourth surfaces 101, 102, 103 and 104 of the body 100 correspond to the wall surfaces of the body 100 connecting the fifth surface 105 and the sixth surface 106 of the body 100, respectively. Hereinafter, both end surfaces of the body 100 refer to the first surface 101 and the second surface 102 of the body 100, and both side surfaces of the body 100 refer to the third surface 103 and the fourth surface 104 of the body 100. One surface of the body 100 refers to the sixth surface 106 of the body 100, and the other surface of the body 100 refers to the fifth surface 105 of the body 100. In addition, hereinafter, the upper and lower surfaces of the body 100 may refer to the fifth surface 105 and the sixth surface 106 of the body 100, respectively, based on the directions of FIGS. 1 to 3.

The body 100 may be formed in such a manner that the coil component 1000 according to this embodiment in which the external electrodes 400 and 500 to be described later are formed has a length of 2.0 mm, a width of 1.2 mm, and a thickness of 0.65 mm, but the embodiment is not limited thereto. Alternatively, the body 100 may be formed in such a manner that the coil component 1000 according to this embodiment in which the external electrodes 400 and 500 are formed has a length of 2.0 mm, a width of 1.6 mm, and a thickness of 0.55 mm. Alternatively, the body 100 may be formed in such a manner that the coil component 1000 according to this embodiment in which the external electrodes 400 and 500 are formed has a length of 2.0 mm, a width of 1.2 mm, and a thickness of 0.55 mm. Alternatively, the body 100 may be formed in such a manner that the coil component 1000 according to this embodiment in which the external electrodes 400 and 500 are formed has a length of 1.2 mm, a width of 1.0 mm, and a thickness of 0.55 mm. However, since the size of the coil component 1000 according to this embodiment described above is merely exemplary, it is not excluded from the scope of the present disclosure that the coil component may be formed in a size other than the above-described sizes.

The body 100 may include magnetic powder (P) and an insulating resin (R). In detail, the body 100 may be formed by laminating one or more magnetic composite sheets including the insulating resin (R) and the magnetic powder (P) dispersed in the insulating resin (R), followed by curing the magnetic composite sheet. However, the body 100 may have a structure other than the structure in which the magnetic powder (P) is dispersed in the insulating resin (R). For example, the body 100 may be formed of a magnetic material such as ferrite.

The magnetic powder (P) may be, for example, ferrite or a magnetic metal powder.

The ferrite powder may be at least one of, for example, spinel ferrites such as Mg—Zn, Mn—Zn, Mn—Mg, Cu—Zn, Mg—Mn—Sr, Ni—Zn and the like, hexagonal ferrites such as Ba—Zn, Ba—Mg, Ba—Ni, Ba—Co, Ba—Ni—Co and the like, garnet ferrites such as Y, and Li ferrites.

The magnetic metal powder may any one or more selected from the group consisting of iron (Fe), silicon (Si), chromium (Cr), cobalt (Co), molybdenum (Mo), aluminum (Al), niobium (Nb), copper (Cu) and nickel (Ni). For example, the magnetic metal powder may be at least one or more of pure iron powder, Fe—Si alloy powder, Fe—Si—Al alloy powder, Fe—Ni alloy powder, Fe—Ni—Mo alloy powder, Fe—Ni—Mo—Cu alloy powder, Fe—Co alloy powder, Fe—Ni—Co alloy powder, Fe—Cr alloy powder, Fe—Cr—Si alloy powder, Fe—Si—Cu—Nb alloy powder, Fe—Ni—Cr alloy powder and Fe—Cr—Al alloy powder.

The magnetic metal powder may be amorphous or crystalline. For example, the magnetic metal powder may be Fe—Si—B—Cr-based amorphous alloy powder, but is not limited thereto.

The ferrite powder and the magnetic metal powder may have an average diameter of about 0.1 μm to 30 μm, respectively, but the diameters thereof are not limited thereto.

The body 100 may include two or more types of magnetic powder (P) dispersed in the insulating resin (R). In this case, the fact that the magnetic powder (P) is different types means that the magnetic powder (P) dispersed in the insulating resin (R) is distinguished by any one of diameter, composition, crystallinity, and shape. For example, the body 100 may include two or more magnetic powder particles (P) having different diameters.

The insulating resin (R) may include an epoxy, polyimide, a liquid crystal polymer, or the like, alone or in combination, but is not limited thereto.

The body 100 includes a core 110 penetrating the support substrate 200 and the coil portion 300, which will be described later. In the process of laminating and curing the magnetic composite sheet, the core 110 may be formed by filling a through-hole of the coil portion 300 by at least a portion of the magnetic composite sheet, but the present disclosure is not limited thereto.

The support substrate 200 is embedded in the body 100. The support substrate 200 is configured to support the coil portion 300, which will be described later.

The support substrate 200 may be formed of an insulating material including a thermosetting insulating resin such as an epoxy resin, a thermoplastic insulating resin such as polyimide, or a photoimageable dielectric resin, or may be formed of an insulating material in which a reinforcing material such as glass fiber or inorganic filler is impregnated in such an insulating resin. As an example, the support substrate 200 may be formed of an insulating material such as a copper clad laminate (CCL), prepreg, Ajinomoto Build-up Film (ABF), FR-4, bismaleimide triazine (BT) film, or Photoimageable Dielectric (PID) film, but the present disclosure is not limited thereto.

As the inorganic filler, at least one or more selected from the group consisting of silica ($SiO_2$), alumina ($Al_2O_3$), silicon carbide (SiC), barium sulfate ($BaSO_4$), talc, mud, mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$).

When the support substrate 200 is formed of an insulating material including a reinforcing material, the support substrate 200 may provide relatively superior rigidity. When the support substrate 200 is formed of an insulating material that does not contain glass fiber, the support substrate 200 is advantageous in terms of reducing the thickness of the overall coil portion 300. When the support substrate 200 is formed of an insulating material including a photoimageable dielectric resin, the number of processes of forming the coil portion 300 may be reduced, which is advantageous in reducing production costs and in forming a fine via.

The thickness of the support substrate 200 may be more than 20 μm and less than 40 μm, and in detail, may be 25 μm or more and 35 μm or less. In one example, the thickness of the support substrate 200 may refer to a distance from one major surface of the support substrate 200 on which the coil portion 300 is disposed to another major surface of the support substrate 200 opposing the one major surface. For example, the thickness of the support substrate 200 may refer to a dimension of the support substrate 200 in the thickness direction T. If the thickness of the support substrate 200 is 20 μm or less, securing the rigidity of the support substrate 200 may be difficult, and thus it is difficult to support the coil portion 300 to be described later in the manufacturing process. If the thickness of the support substrate 200 is 40 μm or more, it is disadvantageous in terms of thinning the coil component, and the volume occupied by the support substrate 200 in the body of the same volume increases, which is disadvantageous in terms of implementing high capacity inductance.

In one example, the thickness of the support substrate 200 may refer to a distance from one point of a line segment corresponding to one surface of the support substrate 200 (e.g., the lower surface of the support substrate 200 based on the direction in FIG. 2) to the other point at which a normal contacts a line segment corresponding to the other surface of the support substrate 200 (e.g., the upper surface of the support substrate 200 based on the direction in FIG. 2), when the normal extends from one point to the other point in the thickness direction T, based on an optical micrograph of a longitudinal-thickness cross-section (an LT cross-section) in a central portion of the body 100 in the width direction W.

Alternatively, based on an optical micrograph of a longitudinal-thickness cross-section (an LT cross-section) in a central portion of the body 100 in the width direction W, the thickness of the support substrate 200 may indicate, when normals respectively extend from a plurality of one points of a line segment corresponding to one surface of the support substrate 200 (e.g., the lower surface of the support substrate 200 based on the direction in FIG. 2), an arithmetic mean of distances from the plurality of one points to a plurality of the other points at which the plurality of normals are in contact with a line segment corresponding to the other surface of the support substrate 200 (e.g., the upper surface of the support substrate 200 based on the direction in FIG. 2).

The coil portion 300 includes flat spiral coil patterns 311 and 312 disposed on the support substrate 200 and is embedded in the body 100 to exhibit characteristics of coil components. For example, when the coil component 1000 of this embodiment is used as a power inductor, the coil portion 300 may serve to stabilize the power of the electronic device by storing the electric field as a magnetic field to maintain the output voltage.

The coil portion 300 includes the coil patterns 311 and 312 and the via 320. In detail, first coil pattern 311 is disposed on the lower surface of the support substrate 200 facing the sixth surface 106 of the body 100, and the second coil pattern 312 is disposed on the upper surface of the support substrate 200, based on the directions of FIGS. 1, 2 and 3. The via 320 penetrates through the support substrate 200 and respectively contacts and is connected to the first coil pattern 311 and the second coil pattern 312. Thus, the coil portion 300 may function as a single coil that forms one or more turns around the core 110 as a whole.

The coil patterns 311 and 312 respectively have a flat spiral shape that forms at least one turn with the core 110 as an axis. For example, the first coil pattern 311 may form at least one turn with the core 110 as an axis, on the lower surface of the support substrate 200, based on the direction of FIG. 2.

Referring to FIGS. 2 and 4, each turn of the coil patterns 311 and 312, based on a cross section perpendicular to one surface of the support substrate 200, is configured in such a manner that a ratio of a thickness T1 to a width Wb of each turn, an aspect ratio (A/R), is 6 or more. In this case, the width Wb of each turn of the coil patterns 311 and 312 may be 25 μm or more, and the thickness T1 may be 200 μm or more. Among the plurality of turns of the coil patterns 311 and 312, a separation distance (S) between adjacent turns may be 8 μm or more and 15 μm or less. However, the scope of the present disclosure is not limited to the above-described numerical values. On the other hand, as will be described later, since a thickness T2 of the first conductive layer is formed to be much thinner than a thickness T1-T2 of the second conductive layer, the thickness T1-T2 of the second conductive layer and the thicknesses T1 of the coil patterns 311 and 312 may be approximately the same as each other. In one example, T1 may refer to a dimension of the coil patterns 311 in the thickness direction T, and T2 may refer to a dimension of the first conductive layer in the thickness direction T. In addition, due to the difference in thicknesses between the first conductive layer and the second conductive layer as described above, the area occupied by the second conductive layer is relatively larger than the area occupied by the first conductive layer, based on the cross sections of the coil patterns 311 and 312. Therefore, the width of the coil patterns 311 and 312 refers to the width Wb of the second conductive layer, and the separation distance between adjacent turns may mean the separation distance S between the second conductive layers of adjacent turns.

Based on, for example, an optical micrograph showing any one turn of the coil pattern 311 (or coil pattern 312) in a width-thickness cross-section (a WT cross-section) in a central portion of the body 100 in the length direction L, the thickness T1 of each turn may refer to, when the normal extends in the thickness direction T from one point of a line segment corresponding to one surface of the one turn contacting one surface of the support substrate 200 (e.g, the lower surface of the support substrate 200 based on the direction in FIG. 2), a distance from the one point to the other point at which the normal contacts a line segment corresponding to the other surface of the one turn, opposing one surface of the one turn. The thickness T2 may be obtained similarly.

Alternatively, based on, for example, an optical micrograph showing anyone turn of the coil pattern 311 (or coil pattern 312) in a width-thickness cross-section (a WT cross-section) in a central portion of the body 100 in the length direction L, when a plurality of normals extend in the thickness direction T from a plurality of one points of a line segment corresponding to one surface of the one turn contacting one surface of the support substrate 200 (e.g., the lower surface of the support substrate 200 based on the direction in FIG. 2), the thickness T1 of each turn may indicate an arithmetic mean of distances from the plurality of one points to a plurality of the other points at which the plurality of normals are in contact with a line segment corresponding to the other surface of the one turn, opposing one surface of the one turn. The thickness T2 may be obtained similarly.

Alternatively, based on, for example, an optical micrograph showing anyone turn of the coil pattern 311 (or coil pattern 312) in a width-thickness cross-section (a WT cross-section) in a central portion of the body 100 in the length direction L, the thickness T1 of each turn may indicate an arithmetic mean of respective thicknesses of the plurality of turns illustrated in the cross-sectional image by the above-described method. The thickness T2 may be obtained similarly.

Ends of the coil patterns 311 and 312 are connected to the first and second external electrodes 400 and 500, respectively, which will be described later. For example, the end of the first coil pattern 311 is connected to the first external electrode 400, and the end of the second coil pattern 312 is connected to the second external electrode 500.

As an example, the end of the first coil pattern 311 is exposed to the first surface 101 of the body 100, and the end of the second coil pattern 312 is exposed to the second surface 102 of the body 100, to be in contact with and be connected to the first and second external electrodes 400 and 500 disposed on the first and second surfaces 101 and 102 of the body 100, respectively.

The coil portion 300 includes a first conductive layer disposed to be in contact with one surface of the support substrate 200 and a second conductive layer disposed on the first conductive layer to be spaced apart from one surface of the support substrate 200. In detail, each of the first and second coil patterns 311 and 312 of the coil portion 300 includes the first conductive layer and the second conductive layer. In the following description, the first conductive layer and the second conductive layer will be described with reference to the second coil pattern 312 to avoid overlapping the description, but the description may also be applied to the first coil pattern 311.

The second coil pattern 312 includes a first conductive layer 312*a* disposed to be in contact with the upper surface of the support substrate 200, and a second conductive layer 312*b* disposed on the first conductive layer 312*a* to be spaced apart from the upper surface of the support substrate 200, based on the directions of FIGS. 2 to 4.

The first conductive layer 312*a* may be formed from a seed layer for the formation of the second conductive layer 312*b* formed by electroplating. The seed layer may be formed by performing electroless plating or sputtering on the support substrate 200. When the seed layer is formed by sputtering or the like, the seed layer may provide a form in which at least a portion of a material constituting the first conductive layer 312*a* penetrates the support substrate 200, which may be confirmed from a difference occurring in the concentration of a metal material constituting the first conductive layer 312*a* in the support substrate 200, in the thickness direction T of the body 100.

The first conductive layer 312*a* may include at least one of molybdenum (Mo), titanium (Ti), chromium (Cr), or copper (Cu). The first conductive layer 312*a* may be formed of a multi-layered structure, such as molybdenum (Mo)/titanium (Ti), but the structure is not limited thereto.

The second conductive layer 312*b* may be formed by forming a plating resist having an opening in the seed layer and then filling the opening of the plating resist with a conductive material by electrolytic plating.

The plating resist may be formed by forming a material for the formation of a plating resist on a seed layer and then performing a photolithography process to form an insulating wall disposed between an opening formed in a planar spiral having a plurality of turns and an adjacent opening. The plating resist may be formed by applying a liquid photoimageable material to the seed layer or laminating a sheet type photoimageable material on the seed layer. The width of the opening of the plating resist (or the separation distance between adjacent insulating walls) corresponds to the width Wb of the coil patterns 311 and 312, and the width of the insulating wall corresponds to the separation distance (S) between the turns of the coil patterns 311 and 312 described above. The thickness of the insulating wall corresponds to the thickness of the coil patterns 311 and 312 described above. The plating resist includes a photoimageable dielectric (PID) that may be peeled off with a stripping solution. For example, the plating resist may include a photoimageable material containing a cyclic ketone compound and an ether compound having a hydroxy group, as a main component, and in this case, the cyclic ketone compound may be, for example, cyclopentanone, or the like, and the ether compound having a hydroxy group may be, for example, poly propylene glycol monomethyl ether, or the like. Alternatively, the plating resist may include a photoimageable material containing bisphenol-based epoxy resin as a main component, and in this case, the bisphenol-based epoxy resin may be, for example, bisphenol A novolac epoxy resin, bisphenol A diglycidyl ether bisphenol A polymer resin, or the like. However, the scope of the present disclosure is not limited thereto, and any plating resist may be used as long as it may be peeled off by a stripping solution. On the other hand, in the case of an exemplary embodiment of the present disclosure, an electroplating layer filling the opening of the plating resist may be formed to have a thickness less than a thickness of the plating resist (the thickness of the insulating wall). In this case, the width Wb of the second conductive layer 312*b* may be constant in an upper portion and a lower portion of the second conductive layer 312*b* in the thickness direction of the second conductive layer 312*b*.

The second conductive layer 312*b* may include copper (Cu). For example, the second conductive layer 312*b* may be formed of copper (Cu) through electrolytic copper plating, but the scope of the present disclosure is not limited thereto. The second conductive layer 312*b* and the first conductive layer 312*a* may be formed of different metals. The second conductive layer 312*b* may be formed of a single layer through a single electroplating process, or may be formed of a plurality of layers through an electroplating process performed multiple times.

The first conductive layer 312*a* is formed to be thinner than the second conductive layer 312*b*. In detail, the thickness T2 of the first conductive layer 312*a* may be 50 nm or more and 10 μm or less. If the thickness T2 of the first conductive layer 312*a* is less than 50 nm, it may be difficult to form the second conductive layer 312*b* by electroplating.

Referring to FIG. 4, one side of the first conductive layer 312*a* is disposed to be closer to a center C of the second conductive layer 312*b* in a width direction of the coil pattern 311 (or 312) than one side of the second conductive layer 312*b*. In one example, a width direction of the coil pattern 311 (or 312) may refer to a direction perpendicular to a winding direction of the portion of the planar spiral pattern of the coil pattern 311 (or 312). In another example, a width direction of the coil pattern 311 (or 312) may refer to a direction perpendicular to a sidewall the portion of the coil pattern 311 (or 312). In detail, since a distance (a) from the one side of the second conductive layer 312*b* to one side of the first conductive layer 312*a* exceeds 0, the one side of the first conductive layer 312*a* is disposed to be closer to the center C of the second conductive layer 312*b* in the width direction of the coil pattern 311 (or 312) than the one side of the second conductive layer 312*b*. As a result, a width Wa of the first conductive layer 312*a* is formed to be less than the width Wb of the second conductive layer 312*b*. On the other hand, the other side of the first conductive layer 312*a* opposing the one side of the first conductive layer 312*a* is also disposed to be closer to the center C of the second conductive layer 312*b* in the width direction of the coil pattern 311 (or 312) than the other side of the second conductive layer 312*b*. The first conductive layer 312*a* is formed by forming the second conductive layer 312*b* on the seed layer and then chemically removing the plating resist using a stripping solution and by selectively removing the seed layer using a seed etching solution. The seed etching solution may react with the seed layer and may not react with the electroplating layer that is the second conductive layer 312*b*. As a result, the first conductive layer 312*a* formed by selectively removing the seed layer may have a shape in which one side is disposed inwardly than one side of the second conductive layer 312*b*.

Referring to FIG. 4, the ratio of the distance (a) from one side of the second conductive layer 312*b* to one side of the first conductive layer 312*a*, relative to the width Wb of the second conductive layer 312*b*, may be greater than 0.1 and less than 0.45. If the ratio is 0, the first conductive layer 312*a* and the second conductive layer 312*b* are formed of the same metal material, so that the seed layer and the second conductive layer 312*b* are removed together in the seed etching solution. In this case, however, component characteristics may be deteriorated due to conductor loss of the second conductive layer 312*b*. If the ratio is 0.45 or more, the seed layer is excessively etched, so that the second conductive layer 312*b* is separated from the support substrate and thus, defects may occur. As a non-limiting example, when the width Wb of the second conductive layer 312*b* is 100 μm, the distance (a) from one side of the second conductive layer 312*b* to one side of the first conductive layer 312*a* may be greater than 0 μm and less than 45 μm.

The ratio of the width Wa of the first conductive layer 312*a* to the width Wb of the second conductive layer 312*b* may be greater than 0.1 and less than 1. If the ratio of the width Wa of the first conductive layer 312*a* to the width Wb of the second conductive layer 312*b* is 0.1 or less, the second conductive layer 312*b* may be separated from the support substrate, resulting in defects. If the ratio of the width Wa of the first conductive layer 312*a* to the width Wb of the second conductive layer 312*b* is 1 or more, component characteristics may be deteriorated due to conductor loss of the second conductive layer 312*b*, a short may occur between adjacent turns. As a non-limiting example, when the width Wb of the second conductive layer 312*b* is 100 μm, the width Wa of the first conductive layer 312*a* may be greater than 10 μm and less than 100 μm.

The via 320 may include at least one or more conductive layers. For example, when the via 320 is formed by electroplating, the via 320 may include a seed layer formed on the inner wall of a via hole penetrating through the support substrate 200, and an electroplating layer filling the via hole in which the seed layer is formed. The seed layer of the via 320 and the seed layer for the formation of the coil patterns 311 and 312 may be formed together in the same process, to be integrally formed with each other, or may be formed in different processes to form a boundary therebetween. The via 320 may include a conductive material such as copper (Cu), aluminum (Al), silver (Ag), tin (Sn), gold (Au), nickel (Ni), lead (Pb), titanium (Ti), chromium (Cr), molybdenum (Mo), or alloys thereof.

The external electrodes 400 and 500 may be formed of a single layer or multiple layers. As an example, the first external electrode 400 may be comprised of a first layer including copper (Cu), a second layer disposed on the first layer and including nickel (Ni), and a third layer disposed on the second layer and including tin (Sn). In this case, the first to third layers may be formed by plating, respectively, but the formation thereof is not limited thereto. As another example, the first external electrode 400 may include a resin electrode including a conductive powder such as silver (Ag) or the like and a resin, and a nickel (Ni)/tin (Sn) plating layer formed on the resin electrode by plating.

The external electrodes 400 and 500 may be formed of a conductive material such as copper (Cu), aluminum (Al), silver (Ag), tin (Sn), gold (Au), nickel (Ni), lead (Pb), titanium (Ti), or alloys thereof, but the material thereof is not limited thereto.

The insulating film 600 may be formed on the support substrate 200 and the coil portion 300. The insulating film 600 is provided to insulate the coil portion 300 from the body 100, and may include a known insulating material such as parylene or the like. Any insulating material included in the insulating film 600 may be used, and is not particularly limited. The insulating film 600 may be formed by a vapor deposition method or the like, but the method is not limited thereto. For example, the insulating film 600 may also be formed by laminating an insulating film on both surfaces of the support substrate 200. In the former case, the insulating film 600 may be formed in the form of a conformal film along the surfaces of the support substrate 200 and the coil portion 300. In the latter case, the insulating film 600 may be formed in a form filling a space between adjacent turns of the coil patterns 311 and 312. On the other hand, the insulating film 600 according to an exemplary embodiment is an optional configuration, and thus, in the case in which the body 100 may secure sufficient insulating resistance in the operating conditions of the coil component 1000 according to this embodiment, the insulating film 600 may be omitted. In this case, the region of the insulating film 600 shown in the drawings, may be filled with an insulating material made of a material of the body 100.

In the coil component 1000 according to this embodiment, a plating resist removal process and a selective seed layer removal process are performed using a chemical solution. For example, the plating resist is removed with a stripping solution or a first etchant, and the seed layer is removed with a second etching solution or a seed etching solution. Therefore, the support substrate 200 may be prevented from being damaged, and the rigidity of the support substrate 200 may be maintained, as compared with the case in which the plating resist and the seed layer are removed together with a laser. Since cavities and/or damages caused by the laser can be avoided, the support substrate 200 may provide a flat surface in a region where at least two adjacent turns of coil patterns and a portion therebetween are disposed. Here, a flat surface may refer to a surface which is perfectly flat, or a surface which is substantially flat in consideration of a roughness which naturally exists and/or in consideration of fluctuation and/or roughness caused by a process error recognizable to one of ordinary skill in the art.

Further, in the coil component according to this embodiment, the seed layer and the electroplating layer may be formed of different metals, and the seed etching solution may react with the seed layer and may not react with the electrolytic plating layer. Therefore, the conductor loss of the second conductive layer 312*b*, which is the electroplating layer, may not occur in the selective seed layer removal process, thereby preventing component characteristics from deteriorating.

Figure 5:
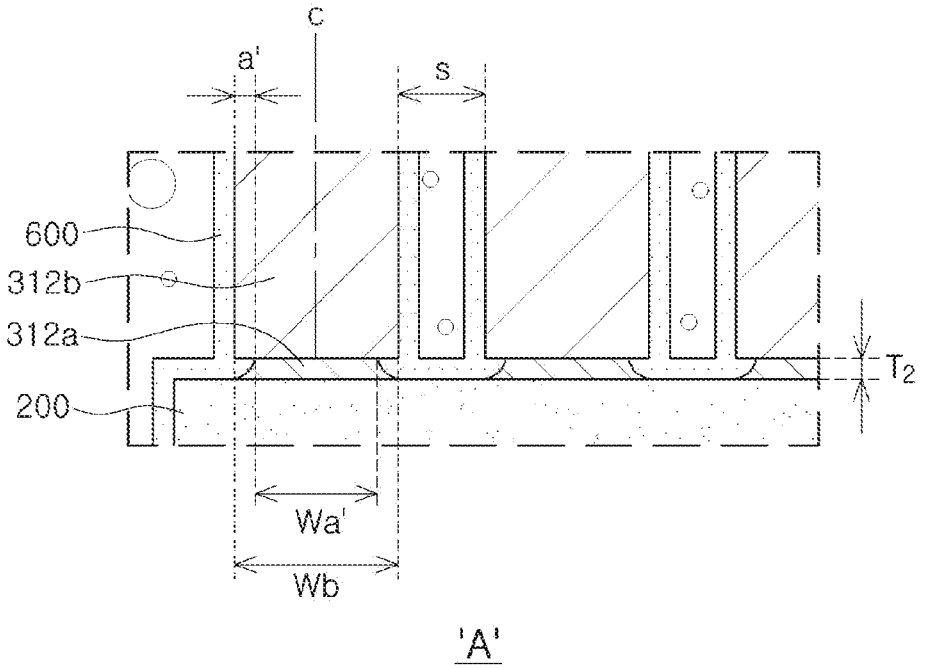
FIG. 5 schematically illustrates a first modification of a coil component according to an exemplary embodiment and is a drawing corresponding to FIG. 4.
Figure 6:
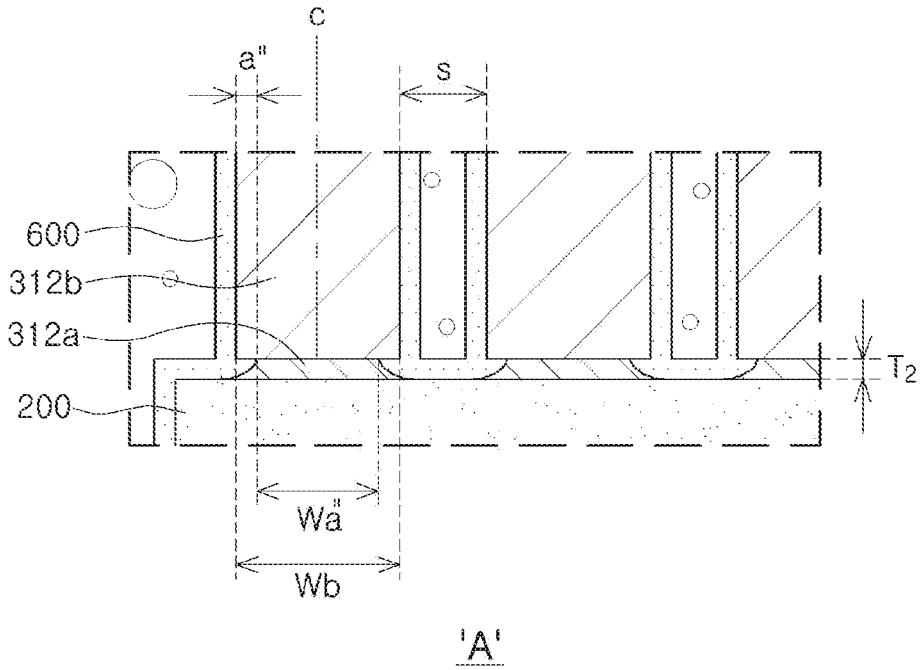
FIG. 6 schematically illustrates a second modification of a coil component according to an exemplary embodiment and is a drawing corresponding to FIG. 4.

FIG. 5 schematically illustrates a first modification of the coil component according to an exemplary embodiment, and is a view corresponding to FIG. 4. FIG. 6 schematically illustrates a second modification of the coil component according to an exemplary embodiment, and is a view corresponding to FIG. 4.

Referring to FIGS. 5 and 6, in the first and second modifications of the coil component according to the exemplary embodiment, one side of the first conductive layer 312*a* is disposed to be closer to the center C of the second conductive layer 312*b* in the width direction of the coil pattern 311 (or 312), on the other surface of the first conductive layer 312*a* that contacts the second conductive layer 312*b* than on one surface of the first conductive layer 312*a* that contacts the support substrate 200. For example, a width Wa' or Wa" of the first conductive layer 312*a* may be increased toward the bottom based on the directions of FIGS. 5 and 6. In the process of selectively removing the seed layer with a seed etching solution, based on the thickness direction of the seed layer, the upper side of the seed layer is exposed to the seed etching solution for a relatively long period of time as compared to the lower side of the seed layer. Thus, the width Wa' or Wa" of the first conductive layer 312*a* formed as the seed layer is selectively etching-removed may increase toward the bottom.

On the other hand, referring to FIGS. 4 to 6, in the case of these modifications, one side of the first conductive layer 312*a* has a curved shape in a cross section perpendicular to one surface of the support substrate 200. Therefore, in these modifications, the fact that one side of the first conductive layer 312*a* is disposed to be closer to the center C of the second conductive layer 312*b* in the width direction of the coil pattern 311 (or 312) than one side of the second conductive layer 312*b*, indicates that an upper region of one side of the first conductive layer 312*a* is disposed to be closer to the center C of the second conductive layer 312*b* in the width direction of the coil pattern 311 (or 312) than one side of the second conductive layer 312*b*, based on the directions of FIGS. 5 and 6. In addition, in these modifications, a distance a' or a" from one side of the second conductive layer 312*b* to one side of the first conductive layer 312*a* may be referred to a distance from one side of the second conductive layer 312*b* to the upper region of one side of the first conductive layer 312*a*.

In the second modification of the coil component according to the exemplary embodiment, on one surface of the first conductive layer, one side of the first conductive layer is disposed outside of one side of the second conductive layer. For example, referring to FIG. 6, based on a cross section perpendicular to one surface of the support substrate 200, a lower portion of one side of the first conductive layer 312*a* is disposed outside of one side of the second conductive layer 312*b*. Therefore, the width of the lower portion of the first conductive layer 312*a* may be greater than the width of the second conductive layer 312*b*.

Table 1 below illustrates the presence of defects and whether or not the support substrate is damaged when the method of manufacturing the coil pattern is changed by using an aspect ratio of 6 or more and a separation distance between turns of 15 μm or less as design dimensions. Experimental Examples 1 to 3 below differ only in the methods to be described later, and the remaining conditions (e.g., the total number of turns of the coil pattern, the material and thickness of the seed pattern or seed layer, the method of forming the seed pattern or seed layer, and the electrolytic plating current and the like) were prepared in the same manner. Whether the coil pattern was defective or not was determined based on whether the distance between the electrolytic plating layers of adjacent turns was 15 μm or less. Whether or not the support substrate was damaged was determined based on whether, with respect to one surface of the support substrate, there is a height difference between an area in which a turn of the coil pattern is formed and an area in which no turn of the coil pattern is formed.

TABLE 1

| | Whether coil pattern is defective or not | Whether support substrate is damaged or not |
|---|---|---|
| # 1 | O | X |
| # 2 | X | O |
| # 3 | X | X |

In the case of Experimental Example 1, a planar spiral seed pattern was formed on one surface of the support substrate, and a plating resist was formed so that an insulating wall of the plating resist was disposed between the turn and the turn of the seed pattern, and then the opening of the plating resist was filled by electroplating, thereby forming the coil pattern. In the case of Experimental Example 2, a seed layer was formed on the entirety of one surface of the support substrate, a plating resist having a planar spiral opening was formed on the seed layer, the opening was filled by electroplating, and the plating resist and the seed layer were removed together by laser, thereby forming the coil pattern. In the case of Experimental Example 3, a coil pattern was formed as in Experimental Example 2, but the plating resist was removed using a first etchant, and the seed layer was selectively removed using a second etchant.

In the case of Experimental Example 1, the support substrate was not damaged, but a defect occurred in the coil pattern. This is because aligning the arrangement of the plating resist is difficult in the process of disposing the plating resist between the turn and the turn of the seed pattern, as the separation distance between the turns of the coil pattern decreases.

In the case of Experimental Example 2, no defect occurred in the coil pattern, but the support substrate was damaged. This is because controlling the amount of laser irradiation is difficult in the process of removing the plating resist and the seed layer.

Unlike Experimental Examples 1 and 2, in the case of Experimental Example 3 which is a method of manufacturing a coil component according to an exemplary embodiment of the present disclosure, no defect occurred in the coil pattern, and the support substrate was not damaged.

As set forth above, according to an exemplary embodiment, the rigidity of a support substrate may be maintained while improving an aspect ratio (A/R) of each turn of a coil pattern.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil component comprising:

a support substrate;

a coil portion including a coil pattern having a plurality of turns on one surface of the support substrate, each of the plurality of turns of the coil pattern including a first conductive layer being in contact with one surface of the support substrate, and a second conductive layer disposed on the first conductive layer to be spaced apart from the one surface of the support substrate; and a body including the support substrate and the coil portion embedded in the body, wherein, based on a cross section perpendicular to the one surface of the support substrate, one side surface of the first conductive layer is closer to a center of the second conductive layer in a width direction of each turn of the coil pattern than one side surface of the second conductive layer, and a space outside the first conductive layer in the width direction between a portion of the second conductive layer and the one surface of the support substrate has a thickness substantially equal to a thickness of a center portion of the first conductive layer.

2. The coil component of claim 1, wherein a ratio of a distance from the one side surface of the second conductive layer to the one side surface of the first conductive layer, with respect to a width of the second conductive layer, is greater than 0.1 and less than 0.45.

3. The coil component of claim 1, wherein the one side surface of the first conductive layer is closer to the center of the second conductive layer in the width direction, on one surface of the first conductive layer contacting the second conductive layer than on another surface of the first conductive layer contacting the support substrate.

4. The coil component of claim 3, wherein on the one surface of the first conductive layer, the one side surface of the first conductive layer is disposed outside of the one side surface of the second conductive layer.

5. The coil component of claim 1, wherein a ratio of a width of the first conductive layer to a width of the second conductive layer is greater than 0.1 and less than 1.

6. The coil component of claim 1, wherein the coil portion has a planar spiral shape having a plurality of turns, wherein an aspect ratio (A/R) of the plurality of turns is 6 or more.

7. The coil component of claim 6, wherein a distance between adjacent turns among the plurality of turns is 8 μm or more and 15 μm less.

8. The coil component of claim 6, wherein the plurality of turns have a width of 25 μm or more and a thickness of 200 μm or more.

9. The coil component of claim 1, wherein the first conductive layer and the second conductive layer comprise different metals.

10. The coil component of claim 1, wherein the first conductive layer comprises molybdenum (Mo), and the second conductive layer comprises copper (Cu).

11. The coil component of claim 1, wherein a portion of the one surface of the support substrate, on which two adjacent turns of coil patterns of the coil portion and a portion between the two adjacent turns are disposed, is flat.

12. A coil component comprising:

a support substrate; and a coil portion including a coil pattern having a plurality of turns on one surface of the support substrate, wherein each of the plurality of turns of the coil pattern includes a first conductive layer being in contact with the one surface of the support substrate, and a second conductive layer disposed on the first conductive layer to be spaced apart from the one surface of the support substrate, based on a cross section perpendicular to the one surface of the support substrate, one side surface of the first conductive layer is closer to a center of the second conductive layer in a width direction of each turn of the coil pattern than one side surface of the second conductive layer, based on the cross section perpendicular to the one surface of the support substrate, at least one of the plurality of turns of the coil pattern is configured in such a manner that a ratio of a thickness of the coil pattern to a width of the second conductive layer is 6 or more, and an area of one surface of the first conductive layer contacting the support substrate is larger than an area of another surface of the first conductive layer contacting the second conductive layer.

13. The coil component of claim 12, wherein a portion of the one surface of the support substrate, on which two adjacent turns of the plurality of turns of the coil patterns and a portion between the two adjacent turns are disposed, is flat.

14. A coil component comprising:

a support substrate;

a coil portion including a coil pattern having a plurality of turns on one surface of the support substrate, each of the plurality of turns of the coil pattern including a first conductive layer being in contact with the one surface of the support substrate, and a second conductive layer disposed on the first conductive layer to be spaced apart from the one surface of the support substrate; and an insulating film disposed in a first space between a portion of the second conductive layer of one of the plurality of turns and the one surface of the support substrate, wherein a thickness of the insulating film disposed in the first space is substantially equal to a thickness of a center portion of the first conductive layer.

15. The coil component of claim 14, wherein the insulating film extends in a second space between another portion of the second conductive layer of another of the plurality of turns and the one surface of the support substrate.

16. The coil component of claim 14, wherein the insulating film is in contact with the one surface of the support substrate.

17. The coil component of claim 14, wherein the insulating film extends on a side surface of the second conductive layer of the one of the plurality of turns.

18. The coil component of claim 14, wherein the first conductive layer and the second conductive layer comprise different metals.

19. The coil component of claim 18, wherein the first conductive layer comprises molybdenum (Mo), and the second conductive layer comprises copper (Cu).

20. The coil component of claim 14, wherein a portion of the one surface of the support substrate, on which two adjacent turns of the coil pattern and a portion therebetween are disposed, is flat.

21. The coil component of claim 14, wherein an aspect ratio (A/R) of the second conductive layer is 6 or more.

22. The coil component of claim 14, wherein a distance between adjacent turns of the second conductive layer is 8 μm or more and 15 μm or less.

23. The coil component of claim 14, wherein the insulating film is in contact with a side surface of the first conductive layer.

* * * * *